United States Patent [19]

Weller

[11] Patent Number: 4,989,850

[45] Date of Patent: Feb. 5, 1991

[54] SIGNATURE MACHINES

[76] Inventor: Ronald W. Weller, 13368 Strawberry La., Orland Park, Ill. 60462

[21] Appl. No.: 330,453

[22] Filed: Mar. 30, 1989

[51] Int. Cl.[5] ..... B41F 13/54

[52] U.S. Cl. ..... 270/1.1; 270/54; 270/55; 270/45; 270/58

[58] Field of Search ..... 270/1.1, 32, 45, 52, 270/54, 55, 57, 58

[56] References Cited

U.S. PATENT DOCUMENTS

| | | | |
|---|---|---|---|
| 4,050,686 | 9/1977 | McCain | 270/54 |
| 4,582,312 | 4/1986 | Abrams | 270/1.1 |
| 4,789,147 | 12/1988 | Berger | 270/1.1 |

FOREIGN PATENT DOCUMENTS

| | | | |
|---|---|---|---|
| 3421208 | 12/1985 | Fed. Rep. of Germany | 270/58 |

*Primary Examiner*—Edward K. Look
*Assistant Examiner*—Therese M. Newholm
*Attorney, Agent, or Firm*—Kinzer, Plyer, Dorn, McEachran & Jambor

[57] ABSTRACT

Signature machine for printing an inside page of a signature as it moves through the machine from a signature supply source to the signature gatherer, made possible by positioning an ink jet printer in a raceway between the supply source and the gatherer. After being printed the signature is folded to bring the inside pages into juxtaposition before being delivered to the gatherer. There may be two supply sources for different signatures, feeding different signatures to be printed differently before being folded one after another.

11 Claims, 1 Drawing Sheet

SIGNATURE MACHINES

INTRODUCTION

This invention relates to signature machines in which signatures (folded sheets) are collected one atop another on a gatherer to complete a book. The book may be stitch bound or it may be a perfect bound book. More particularly, the invention is concerned with printing the inside pages of the signature as it moves through the machine and to the best of my knowledge this has never been accomplished before.

BACKGROUND

It has long been a matter of state of the art to complete a book (magazine) with signatures in a demographic order, that is, signatures in the form of advertisements, return mailing cards and so on oriented to reader interest. The demographics may be geographical, professional, consumer interest and so on.

The signatures are supplied from hoppers or so-called pockets. The cover indeed is the last signature. It is also state of the art to add the name and address of the subscriber to the front of the cover with an ink jet printer. To facilitate mailing, the magazines are usually sequenced in terms of zip code and feeding the signatures demographically has also been programed under the state of the art.

SUMMARY OF THE INVENTION

The demographic signatures are fed from pocket feeders just like the regular text pages for the magazine contents. The demographic signatures usually involve return mailing. The reader removes the insert along a tear line, adds his name and address to the places provided (on the inside page of the signature) and mails the insert. The name and address of the addressee are on the outside of the signature, having been previously printed.

It would be extremely advantageous to be able to print the name and address of the subscriber on the inside of the demographic signature and/or any timely offers, bonuses, service information and so on. Indeed this has been recognized as a need but no solution has been forthcoming.

It is the primary object of the present invention to make possible economic printing of the inside pages of a signature in the course of feeding the signature from the pocket to the gatherer and to do this by placing the signatures in an unfolded state in the pocket, feeding each unfolded signature to a raceway or conveyor where a jet printer is positioned to print the inside page; afterwards the signature is folded (with the added printing on the inside) and then advanced to the gatherer. This solution also has economic advantages of considerable magnitude as will be explained, to say nothing of being able to add printing to a signature at the same time the magazine or book is being compiled.

A BRIEF DESCRIPTION OF THE DRAWING

DETAILED DESCRIPTION

Figures 1, 2, 3, 4, 5, 6:
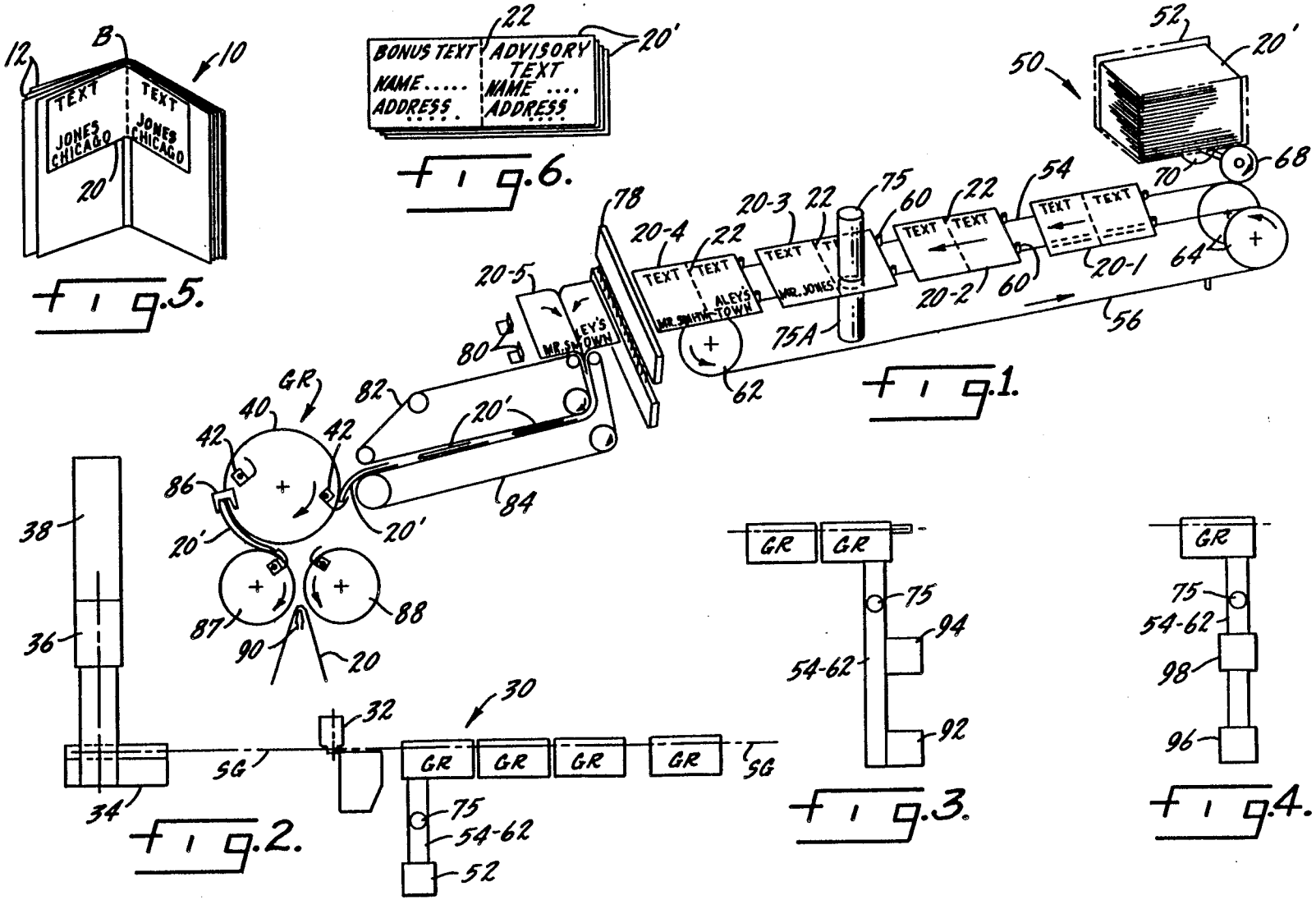
FIG. 1 is a schematic perspective view of the principles of the present invention applied to a particular pocket feeder of a signature machine.
FIG. 2 is a diagrammatic plan view of the floor arrangement of a signature machine in which the present invention may be embodied.
FIG. 3 is a detailed diagrammatic view showing a modified form of practice of the present invention.
FIG. 4 is another diagrammatic view of a modified practice of the present invention.
FIG. 5 is a perspective view of an open magazine incorporating a signature as contemplated by the present invention.
FIG. 6 is a perspective view of a stack of signatures to be added to the pocket feeder, prior to receiving additional printed matter.

A book 10, FIG. 5, as termed herein is a collection of folded page-sized signatures 12, secured at the backbone B. The book 10 is stitch-bound, having a stitched (stapled) V-shaped backbone, but it could also be a perfect bound book (not shown) with a square back.

The book 10 has been opened to expose a smaller folded signature 20, which is a return mailing card having a pre-printed text (TEXT) like the ordinary pages of the magazine. Under the present invention, the signature 20 is additionally printed on an inside page as it moves through the machine 30, FIG. 2, with a name and address shown in FIG. 5 as "Jones Chicago" on one inside page and "Jones Chicago" on the second inside page.

A stack of the signatures with this preprinted text (e.g. BONUS TEXT, ADVISORY TEXT) is shown in FIG. 6. These are signatures 20'. The name and address have not yet been added, nor have the signatures 20' been folded along their fold lines 22.

The entirety of a signature machine for compiling books as 10 is shown diagrammatically in FIG. 2. Individual signatures are fed by gathering feeders GR to a saddle-type gathering chain SG, being gathered one atop another. When the book has been completed, it is calipered at 32 to ensure all the pages are present, and if so advanced by the gathering chain to a stitcher 34 where the backbone is stitched. After stitching the book is trimmed at 36 and next advanced to the mailer 38 where the name and address are applied. It is not necessary to an understanding of this invention to describe the events when a bad book is calipered.

The form of each gathering feeder GR is shown in more detail in FIG. 1. There is a rotating extracting cylinder 40 with a pair of grippers 42 which in timed sequence clamp the folded backbones of successive signatures as 20 fed thereto. In the present instance, the signatures for the particular gathering feeder shown in FIG. 1 are assumed to be like the signature 20 after being printed and folded in accordance with the present invention.

To the best of my knowledge it has not been possible to add additional printing on the inside pages of a signature moving through a signature machine, such as adding a name and address to the inside pages of the signature 20', FIG. 6, which is to become a signature 20 bound inside the book 10, FIG. 5. The need for this has been recognized and in accordance with the present invention adding additional printing matter to a signature being advanced to the gathering chain (or equivalent for a perfect bound book) is made possible by interposing an ink jet printer in a raceway between the gathering feeder and pocket feeder and subsequently folding the signature after the additional printed matter has been added. The pocket feeder is the feeder assembly 50, FIG. 1, where the unfolded signatures 20' are stacked and fed one by one to the raceway, as will now be described with reference to FIGS. 1–4.

Referring then to FIG. 1, the pocket feeder includes a hopper or supply magazine 52 in which the unfolded, text-printed signatures as 20′ are stacked, with the text parallel to the axis of travel of a forward moving raceway represented by a conveyor comprising a pair of spaced endless conveyor chains 54 and 56. The conveyor has pins 60, a pin on each chain in accurate lateral alignment.

The chains are driven synchronously by a pair of driven sprockets 62 (driving means not shown) and are reversed at the opposite or upstream end by idler sprockets as 64.

The supply magazine 52 is positioned above the raceway with the signature fold line 22, FIG. 6, transverse to the path of the raceway. The signatures are indentical in geometry and all have the same pre-printed text.

An extracting cylinder, typically a pair of discs 68 and 70 at the front of the hopper 52, are on a common shaft, rotating clockwise. The extracting cylinder is like the cylinder 40 in that the discs have pairs of extracting grippers (not shown) which clamp the forward leading edge of the lowermost signature in the supply magazine 52. The leading edge is pulled downward and a bit forward by sucker fingers (not shown) so the leading edge of the signature to be extracted may be clamped by the grippers on the extracting cylinder 68–70. The signature 20 extracted follows the arcuate path of the extracting cylinder (being thereby inverted) and is dropped into the raceway upon opening the extracting grippers. The timing is such that the extracted signatures fall into the raceway one following another, the trailing edge of each being picked up and moved in a forward, downstream direction by the feeder pins 60.

A pocket feeder assembly 50, constructed and operated in the manner just described is not new.

As shown in FIG. 1, the signatures in the raceway have pre-printed matter (reading left to right, as usual, and identified as TEXT) parallel to the path of travel, this is, tranverse to the fold line 22 of each signature 20′.

To print the signatures with additional text while in the raceway, an ink jet printer 75 is interposed in the runway downstream of the extracting cylinder 68–70. The printer is of known construction in position to add a name and address in the empty spaces on the upper face of the signature, the empty spaces being indicated by dotted lines in FIG. 6.

The ink jet printer is preferably the one sold by KODAK (Diconix) or the one sold by Video Jet Division of AB Dick. Others can be used. Typically, the ink jet printer is an assembly of many tiny capillary size ink emitters, each head aligned for printing single lines (name, one line; address, second line; and so on). The ink jet printer is programmed demographically to the subscribers, that is, the signature to be incorporated in the magazine mailed to JONES may be followed by an identical signature to be incorporated in the magazine mailed to SMITH.

In the example (FIG. 6) it will be noted the empty spaces of the top-most signature to be printed (on both sides of the fold line) are in alignment across the width of the signature; hence, the printer 75 need not be shifted. Referring to FIG. 5, however, printed material to be added (Jones, Chicago; both sides) is not in alignment across the width of the signature; hence, two printers 75 would have been employed, properly positioned respectively to print lines parallel to the path of the raceway.

As the cylinder 40 continues to turn clockwise, the clamped signature is presented to a register gauge 86. A cooperating lap cylinder 87 and opening cylinder 88 open the signature and drop it onto the saddle conveyor 90. The arrangement and action of the cylinders 40, 87, and 88, coupled with the registered gauge 86 and saddle conveyor 90, are known. What is new is to feed an unfolded signature from a pocket feeder down a raceway past an ink jet printer where printed matter is added to what will be become at least one of the inside pages of the signature, after which the signature is folded so that the inside pages face one another.

As mentioned above, the pocket feeder 52 is arranged above the raceway, FIG. 2, and it is assumed the signatures therein, FIG. 6, are the same size, bearing the same text, differing as to name and address to be added so that the difference in subscriber name is the only demographic difference, herein designated demographics (I).

The economics of the present invention may be realized from the fact that one printer as 75 may be employed to handle different orders of demographics. First, in this connection, it is not practical to add demographics at the printing press because the pocket feeders are loaded by hand (signatures can be lost) nor is the press room geared for this purpose. An ink jet printer costs approximately one quarter of a million dollars. An enormous cost would be involved if several printers 75 had to be assigned to as many raceways, but by the present invention a single printer as 75 can be programmed to meet the additional demographics (II), (III) and so on which for purposes of disclosure may be taken as professional demographics (II) and reader interest demographics (III).

To further clarify the principles of the invention, signature 20-1, FIG. 1, which has just been dropped into the raceway, has the same pre-printed matter TEXT TEXT as the next signature 20-2 downstream.

Signature 20-3 has just been printed with "Mr. Jones" on one side of the fold line; the other part of signature 20-3 (to the right of the fold line) is ready to receive additional printed matter if the printer program calls for it.

The forth signature 20-4 has been printed on one side of the fold line with "Mr. Smith" and on the opposite side with "Aley's Town". Each of these four signatures will be incorporated in successive magazines, all demographically different as determined by the program governing the printer.

Each freshly printed signature as 20-4 is next passed beneath an ink drier 78 and from thence passed to a register gauge or set of stops 80, ready to be folded. The signature so registered is then pressed downward into the bight of a pair of opposed folding and delivering belts 82, 84. This is done by a folding knife, which in FIG. 1 has been omitted to clearly reveal that signature 20-5 is being folded along its fold line (to which the stops 80 are registered). It will be recognized that the signature 20-5 is being folded so that the (inside) printed pages will face one another.

The delivery belts 82–84 advance the folded signature, with the backbone leading, to the cylinder 40, where a set of grippers 42, FIG. 1, are clamping the backbone of a printed, folded signature.

FIG. 2, as already noted, is a floor plan view, and shows the arrangement of a pocket feeder 52 (supply source) and printer 75, assigned to one of the gathering feeders GR. The signatures are identical and will differ only as to the added matter. Of particular advantage is that the ink jet printer may be easily moved back and forth in relation to any of the GR feeders, and there may be several GR feeders having an ink jet printer in its raceway.

Two pocket feeders 92 and 94, FIG. 3, may be arranged at one side of the (lengthened) raceway, respectively assigned to any two of the demographic orders (I), (II), and (III). By such an arrangement, the signatures are fed out of the pockets along an axis at right angles to the path of the raceway. The printer 75 will be programmed accordingly. Or, as shown in FIG. 4, two pocket feeders 96 and 98 in tandem may be placed over the raceway, feeding signatures thereto co-axial with the raceway axis. Again, the printer 75 will be programmed to any two of the demographic orders (I), (II) and (III).

Regardless of the number of different orders going down the raceway, each signature will be printed differently by the printer 75.

The invention can also be applied to the so-called double digest ("two-up", "four-up" and so on to use the terms of art) in which there will be four inside pages, requiring two printing heads 75 laterally spaced, and two more (75A) if the outside is to be printed.

It will be recognized from what has been illustrated and described that by "inside page" of the signature I mean a page on one side of the fold line which will face the other page when folded after the additional printed matter has been added by printer 75. If desired, an ink jet printer 75A, FIG. 1, may be positioned to also print on what will become the outside page. Further, the printer 75A, to print an outside page, could be located in the raceway between the folding station and the feeder GR.

While I have illustrated and described a preferred embodiment of the invention and variations thereof for adding printed matter to a signature in the course of being advanced to the signature gatherer, particularly in terms of arrangements by which one ink jet printer may serve several demographic requirements in a single raceway, it is to be understood the examples are for purposes of disclosure, capable of variation and modification within the purview of the following claims.

We claim:

1. Signature machine for feeding to a signature gatherer folded signatures having inside pages with pre-printed text thereon facing one another, said machine comprising:

a pocket feeder including a hopper for receiving a supply of the pre-printed signatures, in an unfolded state, and also including means to withdraw and feed signatures therefrom one by one to a conveyor having a horizontal run for conveying the signatures, fed thereto from the pocket feeder, in a forward direction toward the gatherer with the pre-printed text parallel to the axis of conveyor travel; an ink jet printer in the raceway downstream of the pocket feeder positioned and oriented to add text to the signature parallel to the pre-printed text thereon; a signature folder downstream of the printer to fold the signature to form a backbone so that the added text is on an inside page of the folded signature, and means to deliver the folded signature to the gatherer.

2. Machine according to claim 1 wherein there are at least two pocket feeders next to one another at one side of the conveyor, the pocket feeders being assigned to different signatures to be differently printed by the printer on a demographic basis.

3. Machine according to claim 1 wherein there are at least two pocket feeders in tandem relation one behind the other and centered substantially to the center line of said conveyor, the pocket feeders being assigned to different signature to be printed differently on a demographic basis.

4. Signature machine according to claim 1 including an extracting cylinder downstream of the signature folder and to which the printed signature is fed with its backbone leading, means to feed the folded signature to the extracting cylinder, grippers on the extracting cylinder to clamp the backbone, said gatherer being a saddle gatherer, and a cooperating lap cylinder and an opening cylinder beneath the extracting cylinder to open the signature and drop it on to the saddle gatherer.

5. Method of adding text to a pre-printed signature in the course of feeding the signature from a pocket to a signature gatherer where said signature is collected along with others to complete a book, comprising the steps of:

placing the pre-printed signature, unfolded, in a supply pocket;

feeding the unfolded signature from the supply pocket to a conveyor having an axis of travel in the direction of the gatherer, with the pre-printed text parallel to said axis of travel;

juxtaposing a jet ink printer to and within the path of the conveyor in position to add text to the signature parallel to the pre-printed text thereon, and so printing at least one page of the signature with added text as it moves past the printer while on the conveyor;

folding the signature before it reaches the gatherer so that the page with added text becomes an inside signature page; and delivering the folded signature to the gatherer.

6. Method according to claim 5 wherein the gatherer is a saddle gatherer and including the steps of opening the folded signature and dropping it on to the saddle gatherer.

7. In a signature machine for feeding to a signature gatherer folded signatures having inside pages with pre-printed text thereon facing one another incidental to gathering other signatures to complete a book, comprising the improvements:

source means to hold a supply of the pre-printed signatures and to feed signatures one by one to a conveyor defining a raceway; said means being located adjacent the conveyor and the conveyor having a horizontal run for conveying the signatures fed thereto in a forward direction toward the gatherer with the pre-printed text parallel to the axis of conveyor travel; an ink jet printer in the raceway positioned and oriented to add text to the signature parallel to the pre-printed text thereon; a signature folder downstream of the printer to fold the signature so the added text is on an inside page, and means to deliver the folded signature to the gatherer.

8. Machine according to claim 7 wherein there is at least a second source means to hold and feed signatures to the conveyor, the two sources being assigned to different signatures to be differently printed by the printer.

9. In a signature machine according to claim 7 in which the fold on the signature constitutes a backbone, said machine including an extracting cylinder downstream of the signature folder and to which the printed signature is fed with its backbone leading, means to feed the folded signature to the extracting cylinder, grippers on the extracting cylinder to clamp the backbone, said gatherer being a saddle gatherer, and a cooperating lap cylinder and an opening cylinder beneath the extracting cylinder to open the signature and drop it on to the saddle gatherer.

10. Method of adding text to successively pre-printed signatures in the course of feeding the signatures one by one to a signature gatherer where said signatures are collected along with others to complete successive books each containing one of the signatures, comprising the steps:

arranging pre-printed signatures, unfolded, in a supply stack;

feeding the unfolded signatures from the supply stack successively to a conveyor having an axis of travel in the direction of the gatherer, with the pre-printed text parallel to said axis of travel;

juxtaposing an jet ink printer to and within the path of the conveyor in position to print added text successively to the signatures parallel to the pre-printed text already thereon, the successively added text being different for each successive signature, and so printing at least one page of each successive signature with added text as it moves past the printer while on the conveyor;

folding each signature before it reaches the gatherer so that the page with added text becomes an inside signature page; and delivering the folded signatures to the gatherer one by one.

11. Method according to claim 10 wherein there are at least two supply stacks of signatures respectively having different pre-printed text, and feeding signatures from both stacks to the conveyor.

* * * * *